United States Patent [19]

Niemi et al.

[11] Patent Number: 4,592,282

[45] Date of Patent: Jun. 3, 1986

[54] CHARGING APPARATUS FOR CARTRIDGED EXPLOSIVES

[75] Inventors: Ingemar Niemi, Hertiggatan; Ingvar Hansson, Barriärvägen, both of Sweden

[73] Assignee: Luossavaara-Kiirunavaara Aktiebolag, Lulea, Sweden

[21] Appl. No.: 629,432

[22] Filed: Jul. 10, 1984

[51] Int. Cl.[4] ..... F42B 3/00

[52] U.S. Cl. ..... 102/313; 86/20 C; 175/4.5; 299/13

[58] Field of Search ..... 102/312, 313; 86/20 C; 175/4.5; 299/13

[56] References Cited

U.S. PATENT DOCUMENTS

| | | | |
|---|---|---|---|
| 4,040,329 | 8/1977 | Ljungberg | 86/20 C |
| 4,040,355 | 8/1977 | Hopler, Jr. | 102/313 |
| 4,066,093 | 1/1978 | Egerstrom | 137/355.2 |
| 4,102,412 | 7/1978 | Sonomura | 102/313 X |
| 4,419,935 | 12/1983 | Shibukawa | 102/312 X |
| 4,466,354 | 8/1984 | Jelberyd et al. | 102/313 |
| 4,501,199 | 2/1985 | Mashimo et al. | 102/312 X |
| 4,508,035 | 4/1985 | Mashimo et al. | 102/312 |
| 4,522,129 | 6/1985 | Jelberyd | 102/312 X |

FOREIGN PATENT DOCUMENTS 400262 3/1978 Sweden .

408594 6/1979 Sweden .

*Primary Examiner*—Peter A. Nelson

*Attorney, Agent, or Firm*—Fleit, Jacobson, Cohn & Price

[57] ABSTRACT

A charging apparatus includes a charging hose, one end part of which is arranged to be connected to at least one supply of particulate or liquid explosive, and the other end part of which is arranged to be inserted into a drill hole to deliver thereto explosive fed through the charging hose from the forementioned supply; a guide sleeve for guiding the charging hose; a hose-feeder arrangement for displacing the charging hose longitudinally in the guide sleeve; and an aligning and adjusting means for carrying the guide sleeve and placing the aforementioned one end of the sleeve in a position for guiding the other end part of the charging hose into the drill hole. The wall of the guide sleeve is provided with a closeable opening arranged to enable bodies of solid explosive or cartridged explosive to be introduced into the guide sleeve when the charging hose is at least partially withdrawn out of the guide sleeve. The guide sleeve comprises two tubes which can be inserted telescopically one within the other, and which are pushed together in their charging-hose guiding position. The opening is formed in one of the two tubes and can be exposed by partially withdrawing the tubes one from the other.

6 Claims, 4 Drawing Figures

CHARGING APPARATUS FOR CARTRIDGED EXPLOSIVES

The present invention relates to a charging apparatus for charging both particulate or liquid explosive and bodies of solid or cartridged explosive, which apparatus includes a charging hose, one end part of which is arranged to be connected to at least one supply of particulate or liquid explosive, and the other end part of which is arranged to be inserted into a drill hole, to deliver thereinto explosive advanced from said supply through said charging hose; a guide sleeve for guiding the charging hose; a hose-feeding arrangement for longitudinal displacement of the charging hose in the guide sleeve; and an aligning and adjusting means for carrying the guide sleeve and for locating one end thereof in a charging position for guiding said other end part of the charging hose into the drill hole.

Charging apparatus of interest are described, for example, in SE Patent Specifications Nos. 75 06593-8 and 75 11025-4.

The object of the present invention is to provide a novel and improved charging apparatus which can be used for charging both particulate and/or liquid explosive and also solid or cartridged explosive.

To this end there is provided in accordance with the invention a charging apparatus of the kind mentioned in the introduction, wherein the guide sleeve comprises two tubes which can be inserted telescopically one within the other, and which are pushed together in their charging-hose guiding position, and wherein an opening is formed in the wall of one of the two tubes and can be exposed, so as to permit bodies of solid or cartridged explosive to be inserted into the guide sleeve formed by said tubes when the charging hose is at least partially withdrawn from the guide sleeve, by partially withdrawing the tubes one from the other. This enables the bodies of solid or cartridged explosive to be inserted, for example manually, through the exposed opening in the guide sleeve in front of the partially with-drawn charging hose in a favourable manner, whereupon the opening is closed by pushing the tubes together and the explosive bodies can be ejected from the sleeve and into a drill hole, by means of the forward end of the charging hose. If desired, the drill hole can then be further filled with liquid or particulate explosive, fed through the charging hose in a conventional manner. When pushed together the tubes can be caused to support one another in a favourable manner, while closure of the opening in said one tube is effected by the other of said tubes.

Advantageously, the said opening can have the form of a slot extending along the major part of the length of the associated tube, among other things in order to facilitate insertion of the explosive bodies into the guide sleeve and also inspection of said bodies, and is preferably formed in the inner of the two tubes.

In order to adapt the arrangement to charging hoses of different diameters, the tubes forming the guide sleeve are advantageously exchangeable and can be releasably held by a respective one of two tube holders which can be displaced relative to one another parallel with said tubes and have arranged therebetween a drive means for displacing said holders and therewith the tubes, and the tube holders may carry a hose feeder adjacent that end of the associated tube which faces away from the drill hole in the charging position. Such positioning of the hose feeder enables the hose to be fed with precision, wherewith the hose feeder may be arranged additional to or as a substitute for the conventional hose feeding means by, for example, driving a drum on which the charging hose is completely or partially wound.

In accordance with a preferred embodiment, the aligning and adjusting arrangement carries the tubes forming said guide sleeve via the other of said tube holders. This simplifies access to the opening in said one of the tubes forming the guide sleeve when said tubes are partially withdrawn one from the other so as to expose the opening.

A particularly advantageous and robust construction is obtained when the tube holders each have the form of an outer tube surrounding a respective one of the tubes forming said guide sleeve, the outer tubes both having a larger cross-section dimension than the guide-sleeve forming tubes and being telescopically displaceable relative to one another, and when the outer tube surrounding the tube having said opening is provided with an opening located opposite the firstmentioned opening.

Additional characterizing features of the invention and advantages afforded thereby are set forth in the following claims and disclosed in or made apparent from the following description of a preferred exemplary embodiment of the invention illustrated in the accompanying drawings.

Figure 1:
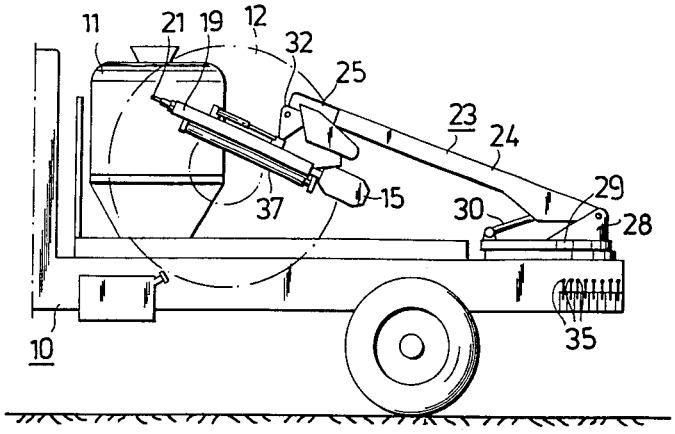
FIG. 1 is a schematic side view of a mobile charging apparatus according to the invention.

In the drawings, the reference 10 identifies a vehicle on which a charging apparatus is mounted. The charging apparatus includes a vessel 11 which is intended to contain liquid or particulate explosive, and a charging-hose drum 12, shown in chain lines in FIG. 1, on which there is wound a charging hose 13, shown in chain lines in FIG. 3. On end part of the charging hose 13 is connected to the vessel 11. With the aid of known means, not shown here, explosives can be transported from the vessel 11 through the charging hose 13, up to and out of the other end part 14 of said hose, which other end part 14 can be fed by means of a hose feeder 15 into drill holes, of which one is illustrated at 16 and which are formed in rock 17 to be blasted. The hose feeder 15 is mounted on one 18, of two co-acting holders 18,19, for a charging-hose guide sleeve formed by tubes 20, 21 (FIG. 4) and described hereinafter in more detail. The other holder 19 is journalled at 22 in an aligning and adjusting arrangement, generally identified at 23, for aligning the adjusting the guide sleeve 20,21 relative to a drill hole to be charged, for example the hole 16.

In the illustrated embodiment, the aligning arrangement 23 comprises a crane construction, which includes a jib comprising sections 24, 25. The sections 24, 25 are telescopically mounted one within the other, and acting between said sections is a piston-cylinder device, indicated at 26, by means of which the length of the jib can be adjusted. The section 24 is pivotally journalled on a pivot 27 mounted on an attachment means 28 arranged on a table 29, which is rotatable about a vertical axis.

Figure 2:
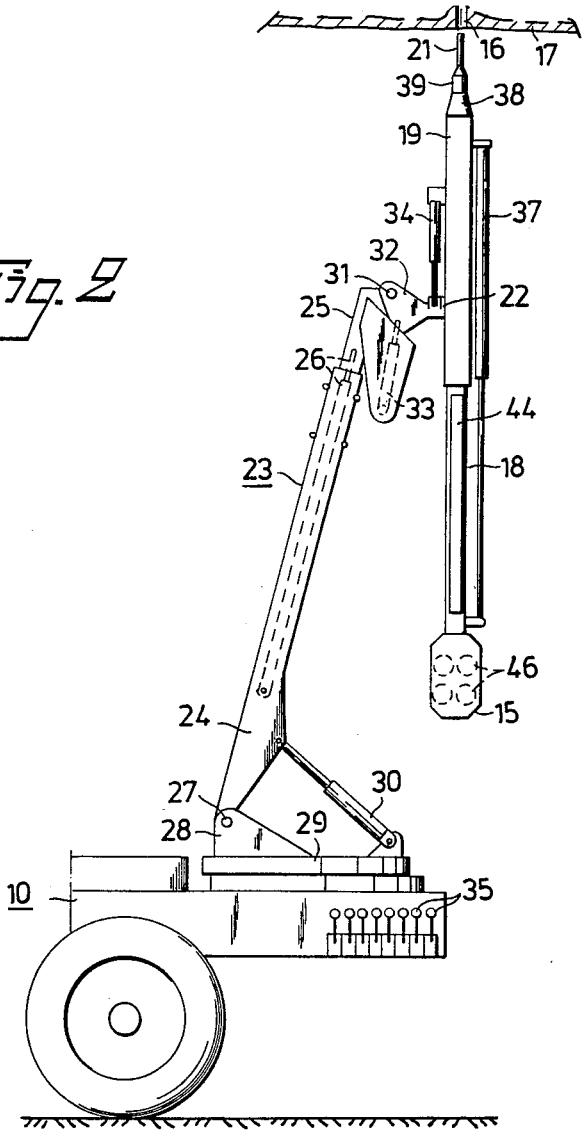
FIG. 2 illustrates, in larger scale, the rear part of the arrangement illustrated in FIG. 1, with the opening of the guide sleeve exposed.

Acting between the section 24 and the table 29 is a piston-cylinder device 30, by means of which the jib 24, 25 can be swung in the plane of the drawing, around the pivot 27. At the end of the jib 24,25 opposite the attachment means 28 is a pivotable arm 32 journalled in the section 25 on a pin 31. The arm 32 is swung by means of a piston-cylinder device 33 active between said arm 32 and a protrusion on the jib section 25. At 22 the holder 19 is journalled for pivotal movement about an axis which extends substantially horizontally in the plane of the drawing in FIGS. 2 and 3. The holder 19 is swung about said axis by means of a piston-cylinder device 34 acting between the holder 19 and a lateral projection on the arm 32. It will be understood that the holder 19, and together therewith the holder 18 with the hose feeder 15 and the tubes 20, 21 forming said guide sleeve can be aligned in practially any position and in any direction by means of the aligning arrangement 23. The reference 35 indicates control levers for manouvering the charging apparatus.

The tubes 20,21 (FIG. 4) forming the guide sleeve for the charging hose 13 can be telescopically inserted one within the other. One tube 20 is provided with a slot-like opening 36, which is covered by the other tube 21 when the tubes 20,21 are pushed together, and is exposed when the tubes 20,21 are partially withdrawn from one another, in the manner illustrated in FIG. 4. The tubes 20,21 are embraced by the holders 18,19, which are also tubular and telescopically displaceable relative to one another. More particularly, the holder 18 is shown to be displaceably guided in the holder 19, axial displacement of the holders 18, 19, and therewith axial displacement of the tubes 20, 21, being effected with the aid of a piston-cylinder device 37 acting between the holders. The tubular holders 18, 19 have a substantially square cross-section, with the exception of an inwardly tapering end part 38 of circular cross-section on the end of the holder 19 remote from the hose feeder 15. The tube 21 is provided at its forward end with a rearwardly directed collar 39 which can be fitted onto the end part 38, the tube 21 being releasably held by the holder 19 with the aid of a bayonette fitting formed by an angular groove 40 in the collar 39 and a radially projecting peg 41 on the end part 38. The tube 20, which is displaceably mounted in the tube 21, is provided on the end thereof located nearest the hose feeder 15 with a widened end part 42, which connects with the inner surface of the holder 18, and is releasably connected to the holder 18 by means of pegs 43 which can be inserted into mutually opposite grooves of semi-circular cross-section formed in the outer surface of the end part 42 and the inner surface of the holder 18. The holder 18 is also provided with an opening 44 opposite the opening 36 in the tube 20. In FIG. 4 there is illustrated a drive motor 45 which is arranged to drive one of a pair of drive rollers, indicated at 46 in FIGS. 2 and 3, of the hose feeder 15, said charging hose 13 being advanced between said rollers.

Figure 3:
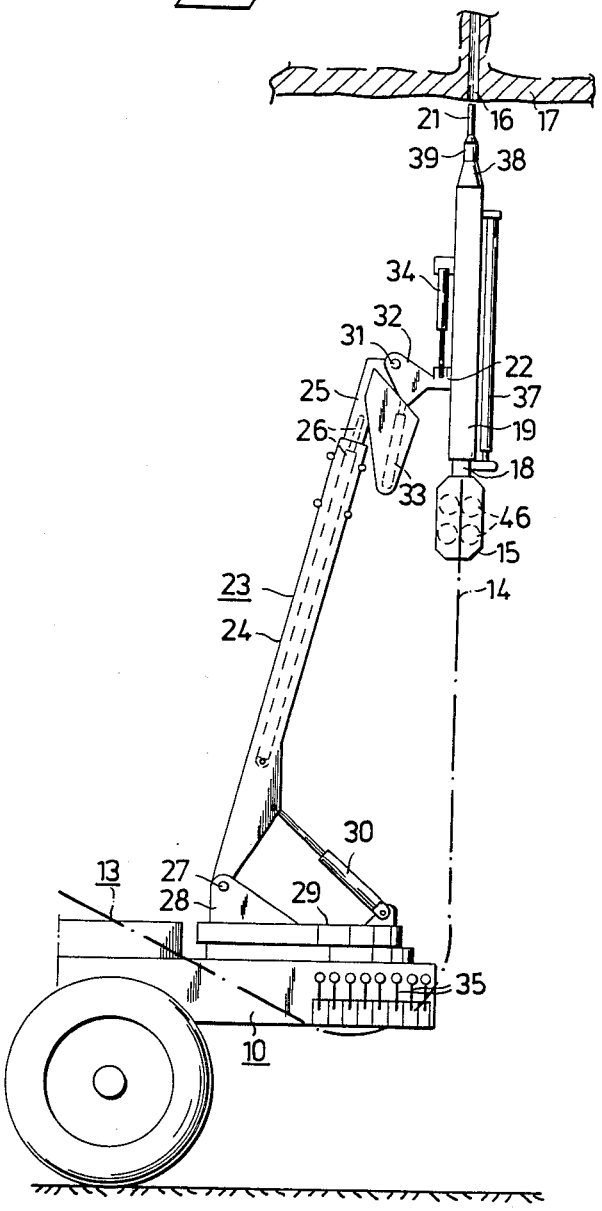
FIG. 3 is a view similar to that of FIG. 2, with the guide sleeve in a normal position for guiding the charging hose.
Figure 4:
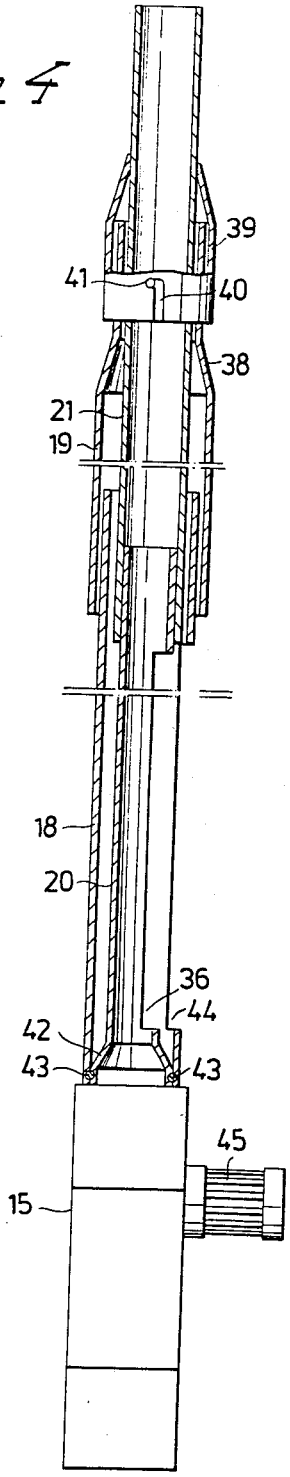
FIG. 4 is an axial sectional view, in larger scale, of parts of the guide sleeve with associated holder.

When using the charging apparatus for charging a drill hole solely with liquid (slurry) or particulate explosive from the vessel 11, the holders 18,19, and therewith the tubes 20,21, pushed one within the other as illustrated in FIG. 3, are aligned adjacent the mouth of the hole 16, coaxially with said hole. The end part 14 of the charging hose 13 is then fed into the hole 16, normally to the bottom of said hole, by means of the hose feeder 15, whereafter explosive is pumped or blown through the charging hose in a conventional manner into the drill hole 16, while withdrawing the charging hose at the same rate as the hole is filled. If desiring to charge the hole 16 completely or, as is often the case, partially with bodies of solid or cartridged explosive, the holders 18, 19 are aligned in position in the aforedescribed manner, although in this case the charging hose 13 is fed backwards so that its forward end is located, for example, in the region of the widened end portion 42 of the tube 20, and the holder 18, together with the tube 20, is moved by means of the piston-cylinder device 37 out of the holder 19 with the tube 21, so that the slot-like openings 36, 44 are exposed in the manner illustrated in FIGS. 2 and 4. The desired number of bodies or cartridges of solid explosive are then inserted through the exposed openings, said bodies or cartridges suitably having a shape and dimensions adapted to the diameter of the tube 20, whereupon the tubes 20,21 and the holders 18,19 are again pushed one into the other by means of the piston-cylinder device 37, as illustrated in FIG. 3. Finally, the charging hose 13 is advanced by means of the hose feeder 15, through and out of the guide formed by the tubes 20,21, whereupon said bodies or cartridges by the forward end of the charging hose are pushed into the hole 16. The charging operation can then be repeated, or the remainder of the hole 16 can be filled with explosive from the vessel 11 in the aforedescribed manner. In order to hold the explosive bodies or cartridges in the drill hole 16, particularly when the hole extends vertically or obliquely upwards, there can be placed, via the openings 36,44, between the end of the charging hose and said bodies or cartridges a known retaining plate, not shown, which is pushed into the hole together with the bodies or cartridges and holds said bodies or cartridges in position in the hole 16, by engagement with the walls of said hole.

As beforedescribed, the tubes 20,21 are detachable, so that they when changing drill hole diameter and charging hose can be replaced with tubes having a diameter suited to the diameter of the new charging hose. In this respect, the widened end-part of the tube having the opening arranged therein and with which the charging hose is guided into the tube, has the same external measurements as the end part 42, and the collar of the other tube has the same measurements as the collar 39, so as to provide a satisfactory support for the tubes.

The invention is not restricted to the embodiment described with reference to the drawings, but that modifications can be made within the scope of the concept of the invention as defined in the claims.

We claim:

1. A charging apparatus for charging both particulate or liquid explosive and bodies of solid or cartridged explosive, said apparatus comprising: a charging hose, one end part of which is arranged to be connected to at least one supply of particulate or liquid explosive, and the other end part of which is arranged to be inserted into a drill hole, to deliver thereinto explosive advanced from said supply through said charging hose; a guide sleeve for guiding the charging hose; hose feeder means for longitudinal displacement of the charging hose in the guide sleeve; and aligning and adjusting means for carrying the guide sleeve and for locating one end thereof in a charging position for guiding said other end part of the charging hose into the drill hole said guide sleeve including two tubes telescopically positioned one within the other, and an opening in the wall of one of said tubes to permit bodies of solid or cartridged explosive to be inserted into said guide sleeve, and means for displacing said tubes between a first, charging hose guiding position, in which said opening is covered by the other of said tubes, and a second, body-receiving position in which said opening is uncovered to permit lateral insertion of bodies of solid or cartridged explosive therethrough.

2. A charging apparatus according to claim 1, wherein said opening has the form of a slot extending along the major part of the length of the associated tube.

3. A charging apparatus as claimed in claim 1, wherein said opening is formed in the inner of said two tubes.

4. A charging apparatus according to claim 1, wherein the tubes forming the guide sleeve are each releasably held by a respective one of two tube holders which are displaceable relative to one another parallel with said tubes, and between which a drive means is active in displacing said holders and therewith said tubes, and wherein one of said tubes holders carries a hose feeder adjacent that end of the associated tube which faces away from the drill hole in the charging position.

5. A charging apparatus according to claim 4, wherein the aligning and adjusting arrangement carries the tubes forming said guide sleeve via the other of said tubular holders.

6. A charging apparatus according to claim 4, wherein each of the tube holders comprises an outer tube surrounding a respective one of the tubes forming said guide sleeve, the outer tubes both having a larger cross-dimension than the tubes forming said guide sleeve and being telescopically displaceable relative to one another, and wherein the outer tube surrounding the tube having said opening is provided with an opening located opposite the firstmentioned opening.

* * * * *